United States Patent [19]

Drabkina et al.

[11] 3,974,322

[45] Aug. 10, 1976

[54] RADIOACTIVE SOURCE

[76] Inventors: Lidia Emelianovna Drabkina, ul. Gagarina, II, kv. 18, Gatchina Leningradskaya oblast; Jury Vatslavovich Mazurek, 2 Murinsky proezd, 44, kv. 145, Leningrad; Dmitry Nikolaevich Myascedov, 10 Linia, 23, kv. 11, Leningrad; Viktor Pavlovich Prokhorov, Shismarevsky per. 16, kv. 1, Leningrad; Vladimir Alexandrovich Kachalov, 2 Murinsky proezd, 44, kv. 26, Leningrad, all of U.S.S.R.; David Moiscevich Ziv, deceased, late of Leningrad, U.S.S.R., by Valentina Spiridonovna Ziv, administratrix

[22] Filed: Dec. 17, 1973

[21] Appl. No.: 425,516

Related U.S. Application Data

[63] Continuation of Ser. No. 226,927, Feb. 16, 1972, abandoned, which is a continuation of Ser. No. 765,274, Oct. 2, 1968, abandoned.

[52] U.S. Cl. ..... 428/433; 250/493; 427/5; 427/248; 427/379; 428/432; 428/472; 428/922

[51] Int. Cl.[2] ..... H05F 3/06

[58] Field of Search ..... 117/220, 69, 169 R, 117/106 A; 250/493; 176/82; 428/472, 539, 433, 432

[56] References Cited

UNITED STATES PATENTS

| | | | |
|---|---|---|---|
| 2,894,846 | 7/1959 | Stoddard | 117/220 X |
| 3,438,803 | 4/1969 | Dubble et al. | 117/106 A |

*Primary Examiner*—Ralph Husack

*Attorney, Agent, or Firm*—Haseltine, Lake & Waters

[57] ABSTRACT

A radioactive layer in a radioactive source is sealed by the application of a sealing layer on the radioactive layer. The sealing layer can consist of a film of oxide of titanium, tin, zirconium, aluminum, or chromium. Preferably, the sealing layer is pure titanium dioxide. The radioactive layer is embedded in a finish enamel which, in turn, is on a priming enamel which surrounds a substrate.

3 Claims, 1 Drawing Figure

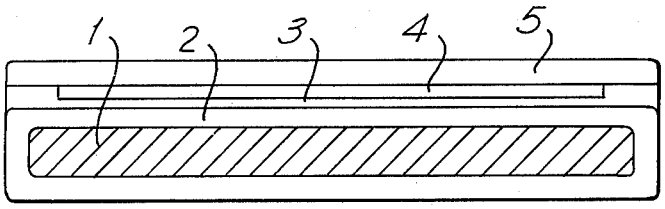
1
2
3
4
5

RADIOACTIVE SOURCE

This application is a continuation of application Ser. No. 226,927 filed Feb. 16, 1972 which in turn is a continuation of Ser. No. 765,274 filed Oct. 2, 1968, both now abandoned.

The present invention relates to nuclear radiation equipment. More specifically, it relates to radioactive sources intended to remove electrostatic charges and to calibrate measuring instruments.

Existing radioactive sources are fabricated by applying a sealing layer in the form of a fused enamel onto a radioactive layer on an enameled metallic substrate.

The manufacture of radioactive sources by the above-mentioned method is a labor consuming, complicated and slow operation, while the sources suffer from lack of hermeticity, resulting in contamination of the surroundings. Also, in such sources, much of the radiation is absorbed by the fairly thick layer of fused enamel.

It is an object of this invention to provide a radioactive source in which no diffusion of the radioactive material to the surface of the source occurs.

It is another object of this invention to provide a mechanically strong radioactive source.

Still another object of this invention is to provide a radioactive source in which the loss of nuclear radiation in the sealing layer is minimized to 10–18 per cent.

It is also an object of this invention to provide a simple and productive method of manufacturing said radioactive sources, independent of critical materials.

With the above and other objects in view, the radioactive source has, according to the invention, a sealing layer which is a film of oxides of titanium, tin, zirconium, aluminum and chromium, used either separately or in combination.

In the manufacture of radioactive sources, this film of metal oxides is produced by hydrolysis of the chlorides of these metals on a heated radioactive layer applied onto a substrate.

The foregoing makes it possible to manufacture inexpensive, high-quality radioactive sources which may be widely used for removal of electrostatic charges in various industries.

Other objects and advantages of the invention will become more fully apparent from the following description of a specific embodiment when read in connection with the accompanying drawing the sole FIGURE of which shows a cross-sectional view of the source of the present invention.

A radioactive source, according to the invention, comprises a substrate 1 coated by a layer of priming silicate enamel 2. One side of the priming enamel 2 is covered by a coat of finish enamel 3 onto which is applied the radioactive material 4, the said material being an alloy of finish enamel 3 and a radioactive substance. The radioactive material 4 is coated by a sealing layer 5 which is a film of a metallic oxide, such as titanium dioxide. As an alternative, the layer 5 may be obtained from oxides of tin, zirconium, aluminum and chromium, used either separately or in combination.

The substrate 1 of the radioactive source may be a glazed ceramic material, or steel onto which the radioactive material is directly applied.

The method of manufacturing the herein proposed radioactive source consists in the following.

The radioactive material is applied on the finish coat of enamel 3 on the already enameled substrate 1. The radioactive material may be applied as a solution of a definite acidity, or as an oxide (mixed with enamel) by electrophoresis. The choice of the method for the application of the radioactive material is determined by the weight of one curie of the radioisotope used.

The application of the radioactive material as a solution is well known.

In the application of the radioactive material by electrophoresis, the substrate 1 is preliminarily given a coat of a metal readily soluble in molten enamel. The radioactive material as an oxide, along with the enamel to be applied together with it, is finely comminuted. Electrophoresis is carried out for 0.5 to 2 minutes. The design of the electrophoresis apparatus depends on the configuration of the source being made. The applied radioactive material, after the liquid phase has been driven off by drying, is fused with the finish enamel 3 at a temperature of 800° to 900°C, with the formation of a radioactive layer 4 which has a smooth, bright surface, free from defects such as pin-holes, burned spots, blisters, and the like. On cooling, the source is washed in running water to remove loose radioactive material.

The source is sealed off with metal oxides, such as titanium dioxide, by producing a film of a metal oxide on the radioactive layer 4 heated to a temperature of 200° to 650°C, by means of vapor-phase hydrolysis of the chloride of a given metal, such as titanium tetrachloride. The sealing operation is continued until a sealing layer is produced in the form of a film of titanium dioxide, or of oxides of the other metals disclosed.

If the sealing layer is to be current-conducting, the layer can be obtained by hydrolysis of tin tetrachloride with the formation of tin dioxide in the form of a film.

A sealing layer in the form of a film of metallic oxide may be obtained by liquid-phase hydrolysis of the respective metallic chlorides, and also by pyrolysis of organometallic compounds.

The radioactive source provided by the invention, manufactured by the present method, does not contaminate the surroundings, is safe to handle, is strong mechanically, and is stable chemically and thermally.

While the invention has been described in connection with a preferred embodiment, it will be understood that various modifications and adaptations may be made without departing in any way from the spirit and scope of the invention, which will be readily comprehended by those skilled in the art.

Such modifications and adaptations should and are intended to be comprehended within the meaning and range of equivalence of the claims that follow.

What is claimed as new and desired to be secured by Letters Patent is:

1. In a radioactive source having a radioactive layer applied on a substrate, the improvement comprising a sealing layer coating said radioactive layer, and an enamel layer interposed between the substrate and the radioactive layer, said sealing layer being pure titanium dioxide.

2. A radioactive source comprising a substrate, a priming enamel on said substrate, a finish enamel on said priming enamel, a radioactive material embeded in said finish enamel and forming a radioactive layer and a sealing layer coating said radioactive layer, said sealing layer consisting of a film of an oxide of one metal selected from the group consisting of titanium, tin, zirconium, aluminum and chromium.

3. A radioactive source as claimed in claim 2 wherein said oxide film is substantially pure and obtained by vapor phase hydrolysis of the respective metal chloride.

* * * * *